US006464935B2

(12) United States Patent
Hazama et al.

(10) Patent No.: US 6,464,935 B2
(45) Date of Patent: Oct. 15, 2002

(54) STEEL FOR SHAFT

(75) Inventors: Yasuhiro Hazama, Tokai; Kenji Takahashi; Michio Okabe, both of Chita, all of (JP)

(73) Assignee: Daido Tokushuko Kabushiki Kaisha, Nagoya (JP)

( * ) Notice: Subject to any disclaimer, the term of this patent is extended or adjusted under 35 U.S.C. 154(b) by 0 days.

(21) Appl. No.: 09/943,731

(22) Filed: Aug. 31, 2001

(65) Prior Publication Data

US 2002/0068006 A1 Jun. 6, 2002

(30) Foreign Application Priority Data

Sep. 1, 2000 (JP) ..... 2000-265422
Aug. 8, 2001 (JP) ..... 2001-240479

(51) Int. Cl.[7] ..... C22C 38/40; C22C 38/60
(52) U.S. Cl. ..... 420/84; 420/41; 420/112
(58) Field of Search ..... 420/41, 84, 112

(56) References Cited

FOREIGN PATENT DOCUMENTS

| | | | |
|---|---|---|---|
| JP | 359185762 A | * 10/1984 | ..... C22C/38/34 |
| JP | 2-170948 | 7/1990 | |
| JP | 6033186 | 2/1994 | |
| JP | 9-176799 | 7/1997 | |
| JP | 11-293409 | 10/1999 | |
| JP | 11-293419 | 10/1999 | |
| JP | 2000-63982 | 2/2000 | |
| JP | 2000-63995 | 2/2000 | |

OTHER PUBLICATIONS

Patent Abstracts of Japan, vol. 2000, No. 05, Sep. 14, 2000 of JP 2000 063995 A, Feb. 29, 2000.
Patent Abstracts of Japan, vol. 2000, No. 05, Sep. 14, 2000 of JP 2000 063982 A, Feb. 29, 2000.
Patent Abstracts of Japan, vol. 018, No. 251, May 13, 1994 of JP 06 033186 A, Feb. 8, 1994.
Patent Abstracts of Japan, vol. 1997, No. 11, Nov. 28, 1997 of JP 09 176799 A, Jul. 8, 1997.
Patent Abstracts of Japan, vol. 2000, No. 01, Jan. 31, 2000 of JP 11 293409 A, Oct. 26, 1999.
Patent Abstracts of Japan, vol. 014, No. 439, Sep. 19, 1990 of JP 02 170948 A, Jul. 2, 1990.
Patent Abstracts of Japan, vol. 2000, No. 01, Jan. 31, 2000 of JP 11 293419 A, Oct. 26, 1999.

* cited by examiner

*Primary Examiner*—Deborah Yee
(74) *Attorney, Agent, or Firm*—Frishauf, Holtz, Goodman & Chick, P.C.

(57) ABSTRACT

A steel for shaft, which has corrosion resistance, machinability, and straightness at substantially the same levels as those of free cutting steel 12L14 plated with Ni, which has conventionally been used as a steel for shaft, and need not be plated on its surfaces, thus making it possible to reduce the production cost therefor, and which comprises: 0.05% by mass or less of C; 0.15% by mass or less of Si; 0.40% by mass or less of Mn; 6.0 to 10.0% by mass of Cr; 0.10% by mass or less of S; 0.30 to 0.80% by mass of Ni; 0.10 to 0.30% by mass of Pb; 0.001 to 0.10% by mass of N; and the balance of Fe and an unavoidable impurity; and a steel shaft composed of said steel.

3 Claims, 1 Drawing Sheet

FIGURE
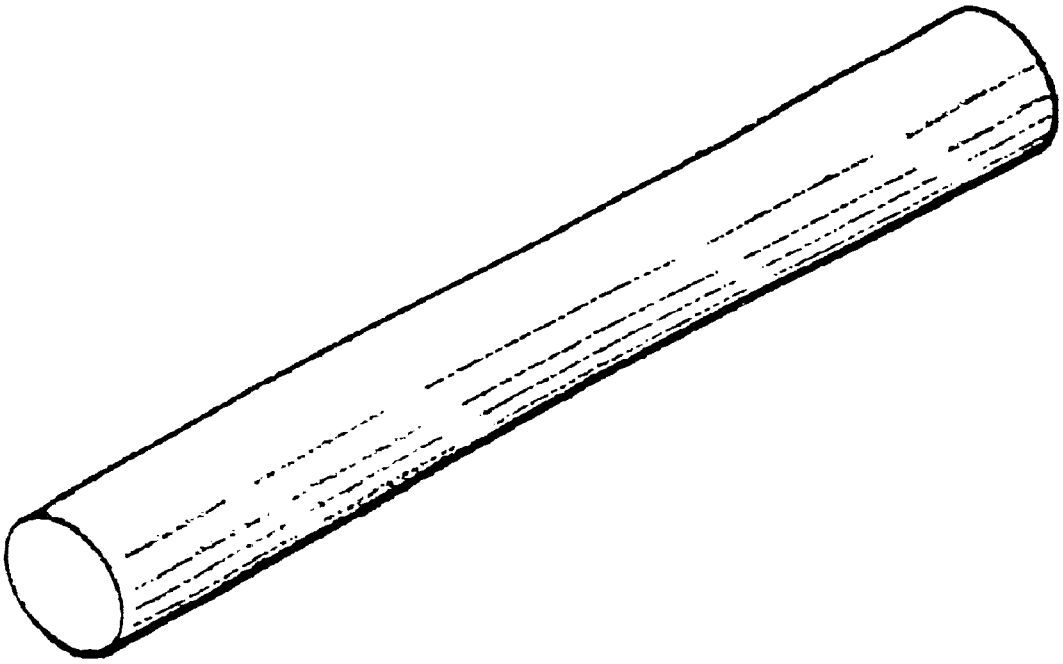

STEEL FOR SHAFT

BACKGROUND OF THE INVENTION

1. Field of the Invention

The present invention relates to a steel for shaft, and more particularly to a steel for shaft for use in the production of various shafts, for example, a shaft for paper feed, a printing head shaft and a scan head supporting shaft incorporated into office automation machines including facsimiles, printers, copying machines, and scanners, which steel is advantageous in that it need not be plated for improving the corrosion resistance, thus making it possible to reduce the cost therefor.

2. Prior Art

Recently, in accordance with the rapid spread of personal computers, demands for, for example, printers are being largely increased. Under these circumstances, the competition for the price of printers is fierce, and it is of urgent necessity to reduce the production cost for printers.

Generally, the current printers are roughly classified into ink-jet printers, such as color printers, and laser printers. These printers have incorporated thereinto a plurality of shafts including a shaft for feeding papers to be printed and a printing head supporting shaft for slidably supporting the printing head. Thus, reduction of the cost for these shafts leads to the reduction in the cost for printers.

Stainless steel, such as SUS416, is generally used in the shaft for laser printer. On the other hand, general free-cutting steel, typified by 12L14, is used in the ink-jet printers including color printers. The 12L14 has an advantage in that its cost is low; however, it poses a problem that the corrosion resistance is poor. For this reason, conventionally, the printer shaft comprised of 12L14 is generally plated with, e.g., nickel so as to impart corrosion resistance to the printer shaft.

However, in the production of such a shaft, a step for plating is required, and thus an increase in the number of steps for production causes the production cost to rise. Further, equipment for the plating step and wastewater disposal equipment inevitably necessary for plating are needed, so that the cost inevitably rises due to the cost for equipment. Furthermore, the plating treatment is not desired from a viewpoint of environmental disruption.

In view of the above, an attempt to use in the ink-jet printer stainless steel having excellent corrosion resistance, such as SUS416, which is used in the shaft for laser printer, can be considered. However, the stainless steel is expensive and therefore, the use of such stainless steel in the ink-jet printer which is of low price is further disadvantageous in the achievement of reduction in the price of the ink-jet printer.

Therefore, development of a steel for shaft, which has excellent corrosion resistance without being plated and enables the whole cost to be reduced, is desired. In addition, the shaft is required both to reduce the cost and to have excellent processability, such as machinability, and excellent straightness. Particularly, in the printing head supporting head, a considerable impact is applied to the shaft during the sliding of the printing head. Therefore, excellent straightness is an important prescribed property.

OBJECT AND SUMMARY OF THE INVENTION

It is an object of the present invention to provide a steel for shaft, which is advantageous not only in that it has excellent corrosion resistance without being plated on its surfaces, but also in that it has excellent processability, such as machinability, and excellent straightness as well as excellent mechanical strength.

For attaining the above object, in the present invention, there is provided a steel for shaft, comprising:

0.05% by mass or less of C; 0.15% by mass or less of Si;

0.40% by mass or less of Mn; 6.0 to 10.0% by mass of Cr; 0.10% by mass or less of S; 0.30 to 0.80% by mass of Ni; 0.10 to 0.30% by mass of Pb; 0.001 to 0.10% by mass of N; and the balance of Fe and an unavoidable impurity.

BRIEF DESCRIPTION OF TEE DRAWINGS

The single FIGURE is a perspective view of a cylindrical shaft according to the present invention.

DETAILED DESCRIPTION OF THE INVENTION

The steel for shaft of the present invention is prepared by ingotting the steel comprising the above-mentioned constituents and blooming the resultant ingot to form 155 mm square steel strips, and then, wire rod milling the steel strips to form a stock (bar stock) having a diameter of 7.5 to 16 mm, and further successively conducting the secondary machining of the stock into a predetermined size, followed by actual use.

The design concept for the steel constituents in the present invention is to let the Cr content be smaller than that of SUS416, which is stainless steel specified in JIS, to reduce the cost and to make up for the lowering of the corrosion resistance due to the reduction in Cr by adding Ni and N which are passivation assisting elements.

Among the above steel constituents, first, Cr is a constituent element for improving the corrosion resistance, and the Cr content is set at 6.0 to 10.0% by mass. When the Cr content is less than 6.0% by mass, the resultant steel does not exhibit a satisfactory corrosion resistance, and, on the other hand, when the Cr content exceeds 10.0% by mass, not only does the cost rise, but also the straightness and the processability become poor.

As mentioned above, Ni and N are constituent elements for making up for, by passivation, the unsatisfactory corrosion resistance obtained only by Cr in the above-mentioned content.

In this case, the Ni content is set at 0.3 to 0.8% by mass. When the Ni content is less than 0.3% by mass, a satisfactory effect (passivation effect) aimed at by the addition of Ni cannot be obtained, and, on the other hand, when the Ni content exceeds 0.8% by mass, the straightness becomes poor and the cost merely rises.

The N content is set at 0.001% to 0.10% by mass. When the N content is less than 0.001% by mass, a satisfactory effect (passivation effect) aimed at by the addition of N cannot be obtained, and, when the N content exceeds 0.10% by mass, the hardness of the resultant steel is increased to lower the processability, especially machinability, and the straightness also becomes poor.

Each of C, N, Si, and Mn is an element for hardening, and by restricting the contents of these elements to the respective predetermined values or less, the processability, especially machinability can be improved, and further the straightness can also be improved.

In this case, the C content is set at 0.05% by mass or less. When the C content exceeds 0.05% by mass, the hardness of the resultant steel is increased to lower the machinability and the straightness.

The N content is as mentioned above. It is preferred that the N content is appropriately determined so as to obtain a good balance between the effect for improving the corrosion resistance and the effect for improving the machinability.

The Si content is set at 0.15% by mass or less. When the Si content exceeds 0.15% by mass, the machinability and the straightness become poor.

The Mn content is set at 0.40% by mass or less. When the Mn content exceeds 0.40% by mass, the machinability and the straightness become poor.

Generally, for example, stainless steel, such as SUS416, has a high hardness and is poor in processability into a shaft, and hence, the stainless steel must be subjected to thermal treatment for improving the processability. However, the steel for shaft of the present invention can realize excellent processability, specifically excellent machinability without a thermal treatment by restricting the contents of the above-mentioned elements for hardening. Therefore, it is possible to reduce the cost for the steel shaft by the cost needed for the thermal treatment.

Further, among the above elements for hardening, Si and Mn are elements which are likely to cause oxidation scales on the surface of the steel. However, in the steel of the present invention, by restricting the contents of these elements, oxidation scales are hardly caused, and there is an advantage in that a step of acid washing for removing oxidation scales can be omitted.

Pb is a constituent for improving the machinability, and the Pb content is set at 0.10% to 0.30% by mass. When the Pb content is less than 0.10% by mass, a satisfactory effect aimed at by the addition of Pb cannot be obtained and the machinability becomes poor, and, on the other hand, when the Pb content exceeds 0.30%, by mass, the hot strength is lowered.

Various types of steels having the compositions shown in Table 1 were individually ingotted, and then cooled to prepare ingots. Each of the ingots was subjected to blooming into 155 mm square steel strips, and the resultant steel strips were subjected to wire rod milling to obtain a wire (wire coil) having a diameter of 9.5 mm, and the wire coil was subsequently annealed to remove scales therefrom, and processed by means of a combined machine into a straight bar, and the bar was finished into a product having a diameter of 8 mm by means of a centerless grinder.

Then, samples each having a diameter of 8 mm and a length of 400 mm were processed from individual bar stocks, and the below-described evaluation examinations were individually conducted with respect to each of the samples. As Reference Example, a shaft for printer was prepared by plating with nickel free cutting steel 12L14 which is a conventionally used material, and the same evaluation examinations were conducted.

1) Machinability

The machinability was evaluated by cutting a sample by means of a cemented carbide bit and examining the depth of wear of the tool cutting edge.

| | |
|---|---|
| Speed of rotation (cutting speed) | 150 m/minute |
| Feeding | 0.03 mm/REV |
| Depth of cut | 1 mm |

The depth of wear of the tool after cutting 500 pieces per sample under the above conditions was measured, and a judgement for the depth of wear was made by "large", "medium", and "small". The criterion for judgement is shown in Table 2.

TABLE 2

| | Tool wear depth (μm) | | |
|---|---|---|---|
| | Small | Medium | Large |
| Traverse relief surface | ≦100 | 100–800 | ≧800 |
| Front relief surface | ≦120 | 120–200 | ≧200 |

In each of Examples 1 to 3, the depth of wear was small, and the machinability was excellent. In each of Comparative Examples 12 and 14 to 17, in which the Cr, N, Ni, C, Si, and Mn contents exceed the upper limits of the respective ranges specified, the depth of wear was large. In addition, in Comparative Example 19 in which the Pb content is lower than the lower limit of the range specified, the depth of wear was large.

2) Corrosion Resistance

Each sample was allowed to stand for 30 days in a high temperature and high humidity atmosphere in which the temperature was 60° C. and the humidity was 95%, and then rusting was examined by visual observation.

In each of Examples 1 to 3, no rusting was recognized. In each of Comparative Examples 1, 13, and 18, in which the

TABLE 1

| | Composition (% by mass) | | | | | | | | | | | |
|---|---|---|---|---|---|---|---|---|---|---|---|---|
| | C | Si | Mn | P | S | Cu | Ni | Cr | Mo | Pb | N | Fe |
| Example 1 | 0.01 | 0.03 | 0.20 | 0.03 | 0.020 | 0.11 | 0.50 | 8.3 | 0.13 | 0.15 | 0.02 | Bal |
| Example 2 | 0.03 | 0.05 | 0.35 | 0.03 | 0.025 | 0.10 | 0.51 | 6.5 | 0.11 | 0.20 | 0.05 | Bal |
| Example 3 | 0.05 | 0.13 | 0.25 | 0.04 | 0.005 | 0.10 | 0.53 | 9.5 | 0.10 | 0.25 | 0.08 | Bal |
| Comp. Ex. 11 | 0.02 | 0.04 | 0.23 | 0.03 | 0.020 | 0.13 | 0.51 | 5.0 | 0.15 | 0.14 | 0.07 | Bal |
| Comp. Ex. 12 | 0.03 | 0.05 | 0.35 | 0.02 | 0.026 | 0.24 | 0.50 | 11.0 | 0.11 | 0.21 | 0.04 | Bal |
| Comp. Ex. 13 | 0.04 | 0.12 | 0.27 | 0.04 | 0.015 | 0.15 | 0.2 | 8.5 | 0.12 | 0.26 | 0.02 | Bal |
| Comp. Ex. 14 | 0.03 | 0.03 | 0.22 | 0.02 | 0.020 | 0.10 | 0.53 | 6.7 | 0.13 | 0.15 | 0.15 | Bal |
| Comp. Ex. 15 | 0.05 | 0.08 | 0.34 | 0.03 | 0.023 | 0.20 | 0.45 | 9.3 | 0.13 | 0.27 | 0.02 | Bal |
| Comp. Ex. 16 | 0.10 | 0.10 | 0.25 | 0.04 | 0.005 | 0.14 | 0.53 | 8.8 | 0.10 | 0.25 | 0.06 | Bal |
| Comp. Ex. 17 | 0.01 | 0.2 | 0.5 | 0.02 | 0.015 | 0.15 | 0.50 | 6.2 | 0.11 | 0.13 | 0.08 | Bal |
| Comp. Ex. 18 | 0.04 | 0.07 | 0.26 | 0.03 | 0.027 | 0.17 | 0.61 | 9.3 | 0.15 | 0.24 | 0.005 | Bal |
| Comp. Ex. 19 | 0.03 | 0.07 | 0.24 | 0.04 | 0.025 | 0.11 | 0.53 | 8.4 | 0.13 | 0.05 | 0.03 | Bal |
| Reference | 12L14 | | | | | | | | | | | |

Cr, Ni, and N contents are lower than the lower limits of the respective ranges specified, rusting was recognized. The results are shown in Table 3.

3) Straightness

The distance between supports was set at 400 mm, and a sample was placed and rotated to measure a deflection of the center portion of the sample by means of a dial micrometer. The unit of the deflection is μm/400 mm width. When the deflection was 0 to 10 μm/400 mm, the straightness was judged to be "large"; when the deflection was 10 to 30 μm/400 mm, the straightness was judged to be "medium"; and when the deflection was 30 to 100 μm/400 mm, the straightness was judged to be "small".

The above results are shown in Table 3.

TABLE 3

| | Machinability | Corrosion resistance | Straightness |
|---|---|---|---|
| Example 1 | Small | No rusting | Small |
| Example 2 | Small | No rusting | Small |
| Example 3 | Small | No rusting | Small |
| Comparative Example 11 | Small | Rusting | Small |
| Comparative Example 12 | Large | No rusting | Large |
| Comparative Example 13 | Medium | Rusting | Medium |
| Comparative Example 14 | Large | No rusting | Large |
| Comparative Example 15 | Large | No rusting | Large |
| Comparative Example 16 | Large | No rusting | Large |
| Comparative Example 17 | Large | No rusting | Large |
| Comparative Example 18 | Medium | Rusting | Medium |
| Comparative Example 19 | Large | No rusting | Large |
| Reference Example Ni-plated 12L14 | Small | No rusting | Small |

As is apparent from the above results, the steel for printer shaft of the present invention shown in each of Examples 1 to 3 has machinability, corrosion resistance, and straightness at substantially the same levels as or higher levels than those of the plated free cutting steel 12L14 shown in Reference Example, which is a conventionally used steel material.

As is apparent from the above description, the steel for shaft of the present invention has corrosion resistance at substantially the same level as or a higher level than that of the plated 12L14 which is a conventionally used steel material, and the machinability and straightness of the steel of the present invention are comparable to those of the plated 12L14.

In addition, the steel for shaft of the present invention need not be plated on its surfaces, and therefore, not only does the simplified steps for production reduce the cost, but also any plating equipment and wastewater disposal equipment inevitably necessary for plating are not needed, so that the production cost can be reduced. Further, the omission of the step for plating treatment largely contributes to the preservation of the environment.

Accordingly, the steel for shaft of the present invention is extremely valuable from an industrial point of view as a substitute for the plated 12L14 which is a conventionally used steel material.

The shaft shown in the single Figure is preferably a cylindrical rod, as shown. Bearings, grooves, etc (not shown) are formed at end portions of the rod by machining so that the shaft can be incorporated into various types of machines.

The above explanation is made on the case where the steel for shaft is applied to the printer shaft, but the use of the steel for shaft of the present invention is not limited to this but can be used in a shaft for paper feed, a printing head supporting shaft, and a scan head supporting shaft which are incorporated into facsimiles, copying machines, and scanners.

What is claimed is:

1. A steel for shaft, comprising:

0.05% by mass or less of C;

0.15% by mass or less of Si;

0.40% by mass or less of Mn;

6.0% to 10.0% by mass of Cr;

0.10% by mass or less of S;

0.30% to 0.80% by mass of Ni;

0.10% to 0.30% by mass of Pb;

0.001% to 0.10% by mass of N; and the balance of Fe and an unavoidable impurity.

2. A steel shaft comprising the steel according to claim 1.

3. A steel shaft consisting essentially of 0.05; by mass or less of C;

0.15% by mass or less of Si;

0.40% by mass or less of Mn;

6.0% to 10.0% by mass of Cz;

0.10% by mass or less of S;

0.30% to 0.80% by mass of Ni;

0.10% to 0.30% by mass of Pb;

0.001% to 0.10% by mass of N; and the balance of Fe and unavoidable impurity(ies).

* * * * *